US008587442B2

(12) United States Patent
Loepfe et al.

(10) Patent No.: US 8,587,442 B2
(45) Date of Patent: Nov. 19, 2013

(54) SMOKE ALARM WITH TEMPORAL EVALUATION OF A BACKSCATTER SIGNAL, TEST METHOD FOR THE FUNCTIONAL CAPABILITY OF A SMOKE ALARM

(75) Inventors: Markus Loepfe, Feldmellen (CH); Kurt Müller, Männedorf (CH); Georges A. Tenchio, Ebmatingen (CH); Walter Vollenweider, Steinhausen (CH)

(73) Assignee: Siemens Aktiengesellschaft, Munich (DE)

( * ) Notice: Subject to any disclaimer, the term of this patent is extended or adjusted under 35 U.S.C. 154(b) by 423 days.

(21) Appl. No.: 12/735,845

(22) PCT Filed: Feb. 16, 2009

(86) PCT No.: PCT/EP2009/051753

§ 371 (c)(1),
(2), (4) Date: Nov. 22, 2010

(87) PCT Pub. No.: WO2009/103667

PCT Pub. Date: Aug. 27, 2009

(65) Prior Publication Data

US 2011/0057805 A1 Mar. 10, 2011

(30) Foreign Application Priority Data

Feb. 19, 2008 (EP) ..... 08101744

(51) Int. Cl.
*G08B 17/10* (2006.01)

(52) U.S. Cl.
USPC ..... 340/628; 340/630; 340/555; 340/577; 340/578; 340/286.05

(58) Field of Classification Search
USPC ..... 340/628, 630, 555, 577, 578, 286.05; 356/377
See application file for complete search history.

(56) References Cited

U.S. PATENT DOCUMENTS

| | | | | |
|---|---|---|---|---|
| 3,917,956 | A * | 11/1975 | Malinowski | 250/564 |
| 4,647,786 | A * | 3/1987 | Guttinger et al. | 250/574 |
| 5,225,810 | A | 7/1993 | Inoue et al. | |
| 5,497,144 | A | 3/1996 | Schappi et al. | |
| 6,300,876 | B1 * | 10/2001 | Sakurai et al. | 340/630 |
| 6,515,589 | B2 | 2/2003 | Schneider et al. | |
| 7,978,087 | B2 | 7/2011 | Siber et al. | |
| 2008/0258925 | A1 | 10/2008 | Siber et al. | |
| 2009/0256714 | A1 * | 10/2009 | Loepfe et al. | 340/628 |

(Continued)

FOREIGN PATENT DOCUMENTS

| | | | |
|---|---|---|---|
| CN | 1111922 | A | 11/1995 |
| CN | 1882968 | A | 12/2006 |
| CN | 1902669 | A | 1/2007 |

(Continued)

*Primary Examiner* — Tai T Nguyen
(74) *Attorney, Agent, or Firm* — Laurene A. Greenberg; Werner H. Stemer; Ralph E. Locher

(57) ABSTRACT

A smoke alarm has a base element with a flat mounting surface, a light emitter that is attached to the mounting surface and that is configured to issue an illuminating light, and a light receiver that is attached to the mounting surface next to the light emitter and that is configured to receive a measurement light that results from a back-scattering of the illumination light at a measurement object located in a detection space. A data processing device is coupled to an output of the light receiver and configured to evaluate temporal changes of an output signal issued by the light receiver. Also, there is provided a method for checking the functional capability of the smoke alarm.

11 Claims, 2 Drawing Sheets

(56) References Cited

U.S. PATENT DOCUMENTS

2010/0118303 A1 5/2010 Nagashima

FOREIGN PATENT DOCUMENTS

DE 102004001699 A1 8/2005
EP 0472039 A2 2/1992
EP 1039426 A2 9/2000
EP 1191496 A1 3/2002
EP 1688898 A1 8/2006
GB 1439325 A 6/1976
WO 9502230 A1 1/1995

* cited by examiner

SMOKE ALARM WITH TEMPORAL EVALUATION OF A BACKSCATTER SIGNAL, TEST METHOD FOR THE FUNCTIONAL CAPABILITY OF A SMOKE ALARM

BACKGROUND OF THE INVENTION

Field of the Invention

The present invention relates to the technical field of alarm signaling technology. The present invention relates in particular to an apparatus that is based on the principle of optical scattered light measurement for the detection of smoke. The present invention further relates to a method for verifying the functional capability of a scattered light smoke alarm.

Smoke alarms typically operate according to the scattered light method. Such alarms exploit the fact that clear air reflects practically no light. If however there are smoke particles in the air, an illumination light emitted by a light source is at least partially scattered at the smoke particles. A part of this scattered light then strikes a light receiver, which is not illuminated directly by the illumination light. Without smoke particles in the air the illumination light therefore cannot reach the light-sensitive sensor.

Scattered light smoke alarms can be divided into two categories. The first category is represented by what are known as closed smoke alarms, which have an optical chamber within a housing. In the event of a hazard smoke can penetrate into the optical chamber and is then detected in the manner described above. The second category is represented by what are known as open smoke alarms. These do not have an optical chamber. Instead smoke outside the open smoke alarm serves as the scatter medium.

A fire alarm and a method for detecting fire are known from EP 0 472 039 A2. The fire alarm has a laser light source, which is configured to emit short laser pulses into a region to be monitored. The fire alarm also features a light detector which is disposed adjacent to the laser light source and which is configured to detect laser light backscattered through approximately 180° by smoke in the region to be monitored or other objects. The position of a backscatter object within the region to be monitored can be determined based on the time difference between emitted and received laser pulses.

A scattered light smoke alarm is known from EP 1 191 496 A1, which features a light emitter and a light receiver. The light emitter and light receiver are disposed at an angle to one another within the scattered light smoke alarm such that their scatter point lies in the open outside the scattered light smoke alarm. This scattered light smoke alarm is therefore what is known as an open smoke alarm. A cover made of transparent plastic, which is disposed between (a) light emitter and/or light receiver and (b) scatter point, protects the scattered light smoke alarm from moisture, aggressive gases and mechanical damage. The scattered light smoke alarm also has a processor, which can be used to analyze the light signals detected by the light receiver in respect of their temporal behavior.

A smoke alarm is known from EP 1 039 426 A2, which features a housing and a light emitter and a light receiver disposed within the housing. A detection region defined by the spatial arrangement of light emitter and light receiver is located outside the smoke alarm. In order to enable a gradual contamination of the smoke alarm to be identified, the light emitter is assigned a control receiver, which is configured to detect radiation emitted from the light emitter. In addition a control emitter assigned to the light receiver is provided, so that the sensitivity of the light receiver can be verified.

BRIEF SUMMARY OF THE INVENTION

The apparatus-related object underlying the present invention is to create a smoke alarm, which despite little outlay on apparatus allows reliable smoke detection and is extremely unlikely to trigger false alarms. A method-related object of the present invention is to specify a reliable method for verifying the functional capability of a smoke alarm.

These objects are achieved by the subject matter of the independent claims. Advantageous embodiments of the present invention are described in the dependent claims.

According to a first aspect of the invention an apparatus for detecting smoke is described, which is also referred to in a shortened manner in the context of this application as a smoke alarm. The smoke alarm features (a) a base element having a flat mounting surface, (b) a light emitter, which is attached to the mounting surface and which is configured to emit an illumination light, (c) a light receiver, which is attached to the mounting surface adjacent to the light emitter and which is configured to receive a measurement light, which results from a backscattering of the illumination light at a measurement object present in a detection space, and (c) a data processing device, which is coupled to an output of the light receiver and which is configured to evaluate temporal changes in an output signal output by the light receiver.

The described smoke alarm is based on the knowledge that the smoke alarm can be implemented by a flat arrangement of all optoelectronic components on a common mounting surface in a particularly flat structure. The detection space here is located outside the actual smoke alarm, so the smoke alarm described is an open smoke alarm.

Reliable smoke detection while at the same time keeping low the likelihood of false detection, possibly triggered for example by an insect penetrating into the detection space or by an object inadvertently introduced into the detection space, can be achieved by a careful evaluation of the temporal profile of the output signal. It is advantageous but not absolutely essential here for the response of the light detector to the intensity of the incident measurement light to be linear. This means that when the strength of the measurement light doubles, the level of the output signal also doubles.

As smoke typically does not spread abruptly within a monitored space, the penetration of smoke into the detection space can be concluded from a slow rise in the output signal. When a concrete object is introduced into the detection space, a very fast rise normally results in the output signal.

Differentiation between the detection of smoke and the detection of an object introduced into the detection space can also be achieved by evaluating signal fluctuations, which follow a rise in the output signal. When smoke is detected a comparatively slow rise is typically followed by some modulations of the measurement light intensity, which are triggered by the formation of clouds of smoke. In contrast after the introduction of an object, left inadvertently by a cleaner for example in the detection space, the measurement light intensity remains at least approximately constant. Therefore modulations in the output signal are at least a strong indication of the presence of smoke or clouds of smoke.

The abovementioned flat structure makes it possible for the smoke alarm described to be integrated without major outlay into the walls and in particular into the ceilings of spaces to be monitored. Even if the described smoke alarm is surface mounted, it can easily be fitted to walls and/or ceilings. In such cases the smoke alarm only takes up a small amount of space. In addition the described smoke alarm can be accommodated discreetly so that it is not perceived as distracting by people in the space being monitored by the smoke detector or at least does not disrupt the design of the space.

The backscatter geometry used means that there is advantageously no need for optical elements such as lenses or mirrors for the light emitter and/or for the light receiver. This enables the described smoke alarm to be manufactured particularly economically so it is also suitable as a low cost mass produced product for monitoring private spaces.

With the smoke alarm described the scattered light is measured in a backscatter geometry of around 180°, in other words between 170° and 190°. The deviation of the scatter angle from an exact backscatter and therefore from exactly 180° results from (a) the distance between the light emitter and the light receiver and (b) the distance between the location of the backscatter and the light emitter or light receiver.

The described smoke alarm differs in particular in the backscatter geometry it uses from conventional smoke alarms which either, as forward scatterers, have a scatter angle of approximately 60° or, as backscatterers, have a scatter angle of around 120° between illumination light and scattered light.

The optoelectronic or photoelectronic components of the smoke alarm can advantageously be semiconductor diodes attached using surface mount technology. The same also applies to electronic components, such as the data processing device, which can likewise be attached directly to the base element. In this case the base element can be a printed circuit board or at least feature a printed circuit board to which the semiconductor emit and semiconductor receive diodes are attached in the known manner and electrically contacted.

It should be noted that within the context of this application the term light basically means electromagnetic waves in any spectral ranges. These also include the ultraviolet, the visible and the infrared spectral ranges for example. Radiation with longer wavelengths such as microwaves for example also represents light within the meaning of the present application. The term light particularly means electromagnetic radiation in the near infrared spectral range, in which light-emitting diodes used as light emitters have an particularly strong luminous intensity. The described smoke detector can however not only be operated with almost monochromatic light radiation but also with light radiation which comprises two or more discrete wavelengths and/or a wavelength continuum.

According to a further exemplary embodiment of the invention the data processing device is additionally configured to evaluate the strength of the output signal. By evaluating the strength of the output signal, which directly reflects the intensity of the received backscattered measurement light, it is possible to obtain additional information about the nature of the scatter object introduced into the detection space. During the evaluation of the strength of the output signal it can be taken into account specifically that the intensity of the measurement light backscattered by smoke particles is typically some powers weaker than the measurement light backscattered by an object.

Naturally the information obtained from the strength of the output signal can also be combined with the information obtained from the temporal profile of the strength of the output signal.

According to a further exemplary embodiment of the invention the light emitter and the light receiver are implemented by a first reflection light barrier. This has the advantage of allowing commercially available reflection light barriers to be used. No relative adjustment between the light emitter and the corresponding light receiver to match the emission direction of the light emitter to the receive direction of the light receiver is required as a result of the fixed relative arrangement of these optoelectronic components within a common component or at least within a common housing. The smoke alarm can thus be constructed in an advantageous manner with little assembly outlay.

According to a further exemplary embodiment of the invention the direction of the illumination light runs perpendicular to the mounting surface. In this context the term direction means the mean emission direction of the light emitter. This means that the light emitter can also have an emission characteristic with diverging light beams which have a certain angular distribution around the mean emission direction perpendicular to the mounting surface. The backscatter geometry used means that this of course also applies to the measurement light, which also runs on average perpendicular to the mounting surface.

According to a further exemplary embodiment of the invention the light emitter is configured to emit a pulsed illumination light.

The use of pulsed illumination light advantageously allows the light emitter to be operated for a short time with a particularly large current, which is greater than the maximum current that in continuous operation of the light emitter does not result in thermal destruction of the light emitter. Since the light emitter can cool down in the time between two successive light pulses, such a dimensionally excessive current does not result in destruction of the light emitter. Since a large current also results in greater light emission in the case of light-emitting diodes in particular, it is possible to achieve greater sensitivity and therefore particularly good reliability of the described smoke alarm by using pulsed illumination light.

It should be noted that pulsed illumination light can also be used in conjunction with a light receiver that features a temporal resolution that is greater than the delay time of the light from the source by way of the scattering smoke particles and back to the receiver. This allows additional information to be obtained about the backscatter behavior and/or the spatial position of the measurement objects detected by the described smoke alarm.

With the described smoke alarm the scatter volume, in which smoke is generally detected, is very close to the smoke alarm. The scatter volume here can have a spatial extension of less than approximately 5 cm. The delay time of the measurement light for the return path is then typically in the range of at least several picoseconds.

With the simple reflection light barriers currently in use at the time of the application pulse durations are typically in the range of 1 to 100 microseconds. The spatial distribution of smoke within the scatter volume cannot therefore really be resolved currently with light barriers in the lower price range. However it seems very likely given the very rapid developments in the field of optoelectronics that low-cost short-pulse light-emitting diodes having a pulse length of just nanoseconds or even picoseconds and corresponding photodiodes will be developed in the very near future. It will then be possible to use these to obtain information about the spatial distribution of the light scatter.

Since the described smoke alarm is preferably used to detect smoke particles that are closer than approximately 10-50 mm from the light emitter or light receiver, particles further away only contribute to the smoke detection signal in an infinitesimal and non-resolvable manner. Solid objects that are closer than approximately 50 mm away from the smoke alarm are thereby determined by way of a very strong backscatter signal amplitude. Objects further away can be identified as such in some instances by way of the delay time or the associated broadening of the pulse. A distance of 30 cm here corresponds to a return delay time or pulse broadening of 2 ns. However it is easiest to eliminate reflections from the floor by way of the delay time, in so far as the described smoke alarm is mounted on the ceiling of a space to be monitored. A ceiling height of 3 m then produces a return delay time of 20 ns.

When using very short light pulses it is also possible, by measuring the time difference t between the transmission of an illumination light pulse and the backscattered measurement light pulse detected by the light receiver, to determine how far the respective scatter object is from the light emitter or light receiver.

Even though using pulsed illumination light has many advantages in respect of reliable and error-free smoke detection, it should be noted specifically here that the smoke alarm described above can of course also be operated with a continuous illumination light.

According to a further exemplary embodiment of the invention the light emitter and light receiver respectively represent an outer boundary of the apparatus for detecting smoke. This means that neither the light emitter nor the light receiver is located within a housing of the described smoke alarm. Thus no other parts of the described smoke alarm are located outside the photoelectric components in the form of the light emitter and light receiver. This also applies to covers or housing parts. The smoke alarm can thus be embodied so that no further—optionally optically transparent—cover is present between the photoelectric components and the detection space, to protect the photoelectric components from contamination. These types of cover or contamination shields are however not even required for many applications, especially in the domestic field.

According to a further exemplary embodiment of the invention the smoke alarm also features (a) a further light emitter, which is attached to the mounting surface and which is configured to emit a further illumination light, and (b) a further light receiver, which is attached to the mounting surface adjacent to the further light emitter and which is configured to receive a further measurement light, which results from a backscattering of the further illumination light at a measurement object present in a further detection space.

The data processing device here can also be configured for the common evaluation of the output signal and a further output signal of the further light receiver. Common evaluation of the output signals output by the light receiver and the further light receiver allows additional information to be obtained about the nature and optionally also the position of a scatter object.

The described smoke alarm can be operated for example in an asymmetrical operating mode, in which both light receivers but only one of the two light emitters are active. This means that only one of the two light emitters emits an illumination light. If in this operating mode both light receivers show at least approximately the same signal then a remote echo is obviously present. This can stem from a reflection of the illumination light emitted by the active light emitter at an object far away, such as the floor of a space being monitored for example.

In the event of a hazard, in which smoke penetrates into or occurs in the space being monitored, the smoke will also penetrate at least partially into the near environment of the smoke alarm, so that the two light receivers receive a very different measurement signal. In this case the light receiver which is assigned to the switched-on light emitter will receive measurement light at a far greater intensity than the other light receiver. This allows objects far away and having a basically strong backscatter, which due to their far distance only bring about a weak backscatter signal, to be differentiated reliably from smoke, which has a basically weak backscatter but is close to the smoke alarm.

It should be noted that the further light emitter and the further light receiver can be embodied or disposed in an identical manner to the light emitter and light receiver described above. This applies in particular to the combination of the further light emitter and the further light receiver in a further light barrier.

The mean directions of both the first illumination light and the second illumination light are preferably aligned perpendicular to the mounting surface. This means that the illumination light beam and the further illumination light beam run parallel to one another. The distance between the detection space and the further detection space is therefore essentially a function of the distance between the two light emitters or between the two light receivers.

According to a further aspect of the invention a method is specified for verifying the functional capability of a smoke alarm of the type described above. The method features (a) the introduction of a scattering reference object into the detection space, the object being held in the same position at least for a predetermined time period, (b) an evaluation of temporal changes in the output signal output by the light receiver and (c) the outputting of a test alarm message if the temporal changes correspond to a predetermined profile.

The abovementioned method for triggering a test function of the smoke alarm described above is based on the knowledge that it is possible to test the whole smoke alarm including the optical system made up of light emitter, light receiver and an evaluation implemented in the data processing device, by simply advancing a concrete object. In this process it is possible to identify different signal profiles by means of appropriate signal processing and thus to differentiate clearly for example between smoke clouds and an intentional triggering of the test function. The described triggering of the test function therefore does not just test the functional capability of an alarm emitter such as a siren or optical alarm display facility for example.

The object is preferably advanced into proximity to the smoke alarm. The object can be any solid or liquid object, which has a surface that scatters light to a high degree compared with smoke. The object can also be the hand of an operator.

A test rod for example is suitable for advancing the object. This is the case in particular when the smoke alarm is attached to the ceiling of a space being monitored. A conventional broom with a correspondingly long handle is therefore an extremely suitable object for triggering the test function of the smoke alarm.

The trigger time for the test function or the time during which the test object has to be held in proximity to the smoke alarm can be defined precisely. However if an object is then present for much longer period in front of the smoke alarm, this means that the line of sight of the smoke alarm is blocked by a fixed object. This is a fault and can likewise be detected and reported correspondingly by the signal processing software implemented in the data processing device.

According to one exemplary embodiment of the invention the method also features movement of the reference object according to a predetermined temporal pattern, the predetermined profile corresponding at least qualitatively to the predetermined temporal pattern.

This means that the triggering of the test function can also be coded, in that for example the test object is moved into proximity to the smoke alarm two or three times and removed again within a defined time. A previously defined suitable coding also allows different test sequences to be triggered. The coding can also serve to differentiate the trigger function for the test clearly from other malfunctions, such as for example insects penetrating into the detection space.

Further advantages and features of the present invention will emerge from the description of examples of currently preferred embodiments which follows. In the individual figures in the drawing in this application, which should only be seen as schematic and not to scale:

DESCRIPTION OF THE INVENTION

Figure 1:
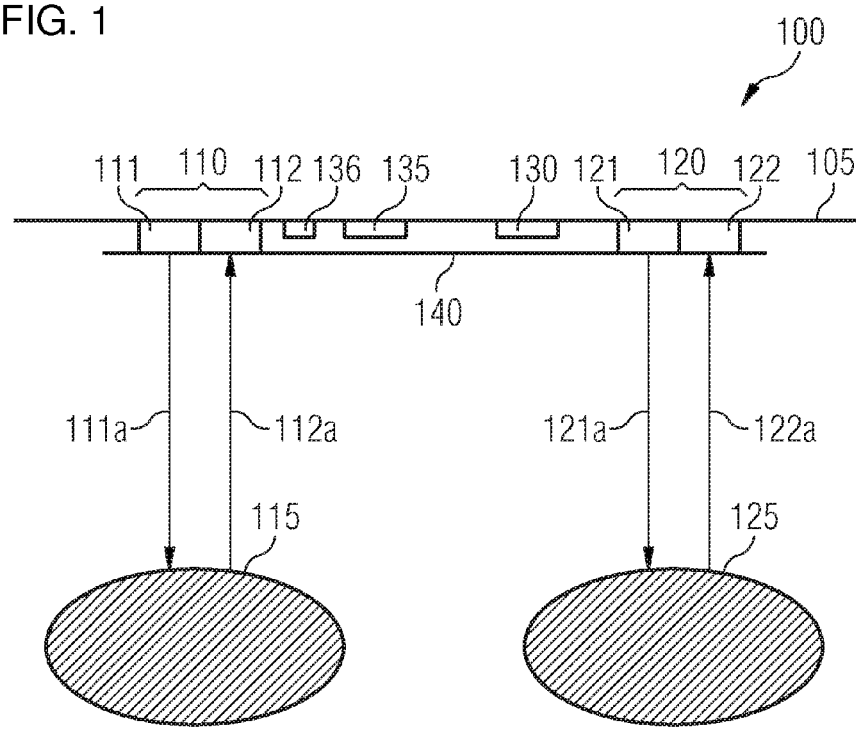
FIG. 1 shows a schematic cross-sectional diagram of a smoke alarm with two reflection light barriers attached to a common printed circuit board.

It should be noted at this point that the reference characters of identical or corresponding components in the drawings only differ in their first digit.

FIG. 1 shows a smoke alarm 100, which has a base plate 105. According to the exemplary embodiment illustrated here the base plate is a printed circuit board 105 or a suitable circuit carrier for receiving electronic and optoelectronic components. All components fitted to the printed circuit board 105 are contacted in a manner not shown by means of conductor tracks or electrical wire connections in a suitable manner.

The smoke detector 100 comprises a first reflection light barrier 110 and a second reflection light barrier 120. The first reflection light barrier 110 features a first light emitter 111 and arranged directly adjacent to it in a common housing a first light receiver 112. The second reflection light barrier 120 features a second light emitter 121 and arranged directly adjacent to it in a common housing a second light receiver 122.

The first light emitter 111 emits a first illumination light 111*a* perpendicular to the plane of the printed circuit board 105. The first illumination light 111*a* is backscattered at least partially through approximately 180°, i.e. between 170° and 190°, in a first detection space 115, in which smoke is present for example. The backscattered light reaches the first light receiver 112 as first measurement light 112*a*.

In a corresponding manner the second light emitter 121 emits a second illumination light 121*a* perpendicular to the plane of the circuit board 105. The second illumination light 121*a* is backscattered at least partially through approximately 180° in a second detection space 125 in which smoke is present for example. The backscattered light reaches the second light receiver 122 as second measurement light 122*a*.

The smoke detector 100 further features a subtraction unit 136 which forms a difference signal from the output signals of the two light receivers 112 and 122. This difference signal is fed to a data processing device 135 of the smoke detector 100.

A control facility 130 is also provided, which is coupled to the two light emitters 111 and 121. This enables the two light emitters 111 and 121 to be activated and/or switched on independently of one another.

All components 110, 120, 130, 135 and 136 of the smoke alarm 100 are attached to the printed circuit board 105 and electrically contacted in a suitable manner. This enables the smoke alarm 100 to be implemented in a very flat structure. The height of the smoke detector 100 in this case is determined merely by the thickness of printed circuit board 105 and by the components 110, 120, 130, 135 and 136.

According to the exemplary embodiment illustrated here all components 110, 120, 130, 135 and 136 are what are known as surface mount technology (SMD) components. This allows an overall height of just 2.1 mm to be achieved for example. The overall height in this case is produced by the distance between the upper face of the printed circuit board 105 and the lower surface of the smoke alarm labeled in FIG. 1 with the reference character 140.

According to the exemplary embodiment illustrated here the light-active surfaces of the light transmitters 111, 121 and the light receivers 112, 122 coincide with the surface or outer boundary 140 of the smoke detector 100. This means that between these light-active surfaces and the respective detection space 115, 125 there are no further parts of the smoke detector 100. This also applies to covers or housing parts. These types of covers, which are frequently provided with known smoke alarms for the purposes of preventing contamination, are however not required at all with many applications, especially in the domestic field. In addition light barriers can also be used which already have transparent protection layers for the light-active surfaces of the light transmitters 111, 121 and the light receivers 112, 122, so that at least some degree of protection against contamination is provided.

The described smoke alarm 100 with two reflection light barriers aligned in a parallel manner has the advantage that it does not feature any optical elements such as for example lenses or mirrors. This enables the smoke alarm to be manufactured in a particularly simple manner with low-cost components. There are also no special mounting tolerances to take into account when assembling or mounting the smoke alarm. All components required for the smoke alarm are mass-produced components which can be manufactured at low cost.

According to the exemplary embodiment illustrated here the data processing device 135 is configured in such a manner that the temporal profile of the output signal can be evaluated precisely. To achieve a high quality for the evaluation as a whole, the light receivers 112 and 122 have a linear response. This means that the level of the output signal is directly proportional to the incident light intensity in each instance.

Since smoke typically does not spread abruptly within a space being monitored, the penetration of smoke into the detection space can be concluded from a slow rise in the output signal. When a concrete object is introduced into the detection space, there is normally a very rapid rise in the output signal.

Figure 2:
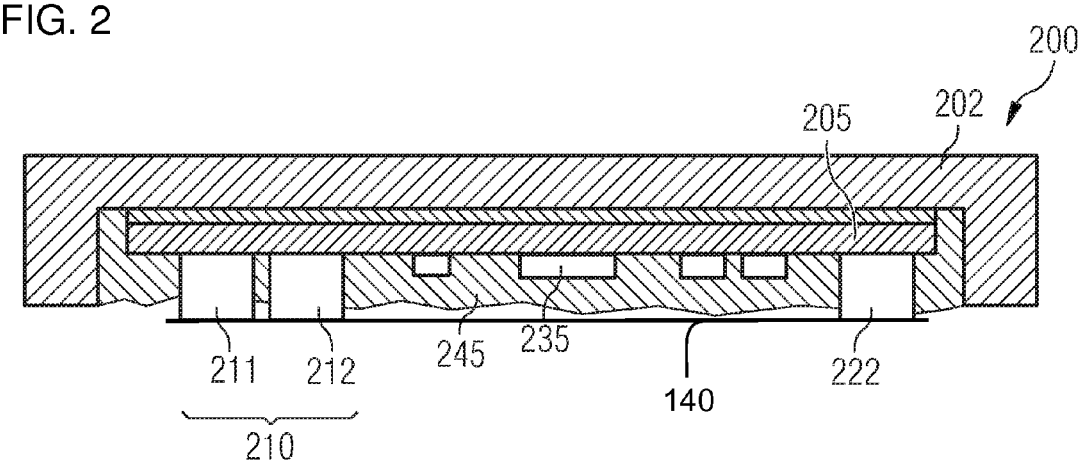
FIG. 2 shows a cross-sectional diagram of a smoke alarm, featuring a light emitter and two light receivers, which are attached to an electronic printed circuit board as SMD components.

FIG. 2 shows a cross-sectional diagram of a smoke alarm 200 according to a further exemplary embodiment of the invention. The smoke alarm 200 has a flat housing 202, in which a base plate 205 embodied as a printed circuit board is located. A number of electronic and optoelectronic components are attached to the printed circuit board 205, each being contacted in a suitable manner.

The most important optoelectronic component of the smoke alarm 200 is a reflection light barrier 210, which comprises a light emitter 211 and a first light receiver 212. The reflection light barrier 210 is constructed and operated in precisely the same manner as the reflection light barrier 110 of the smoke alarm 100 illustrated in FIG. 1.

The smoke alarm 200 also features a second light receiver 222, which is also attached to the printed circuit board 205 at a certain distance from the light barrier 210. The smoke alarm 200 can thus be operated in the asymmetrical operating mode described above. The smoke alarm 200 further features a data processing device 235, which can be used to analyze or evaluate the temporal profile of the output signal.

Further electronic components are attached to the printed circuit board 205, these being illustrated in FIG. 2 but not being described in more detail. These components can be for example driver circuits for the light emitter 211, amplifier circuits for the two light receivers 212 and 222, evaluation circuits cast in hardware, such as for example a subtraction circuit or any other circuits provided for the operation of the smoke alarm 200.

In order to guarantee that the smoke alarm 200 and in particular the electronic and optoelectronic components have a high level of mechanical strength, a casting material 245 is also provided, which at least partially encloses the components attached to the printed circuit board. When the originally liquid casting material was introduced, it was ensured that the optoelectronic components 211, 212 and 222 were not completely enclosed. Therefore with the smoke alarm 200 the optically active surfaces of the light transmitter 211, the first light receiver 212 and the second light receiver 222 at the corresponding points represent the outer boundary 140 of the smoke alarm 200. Apart from the photoelectronic components in the form of light transmitters and light receivers there are therefore no other parts such as covers or housing parts. The smoke alarm can therefore be embodied so that there is no optically transparent cover between the optically active surfaces of the components 211, 212 and 222 and a detection space (not shown in FIG. 2) to protect the components 211, 212 and 222 from contamination.

Figure 3:
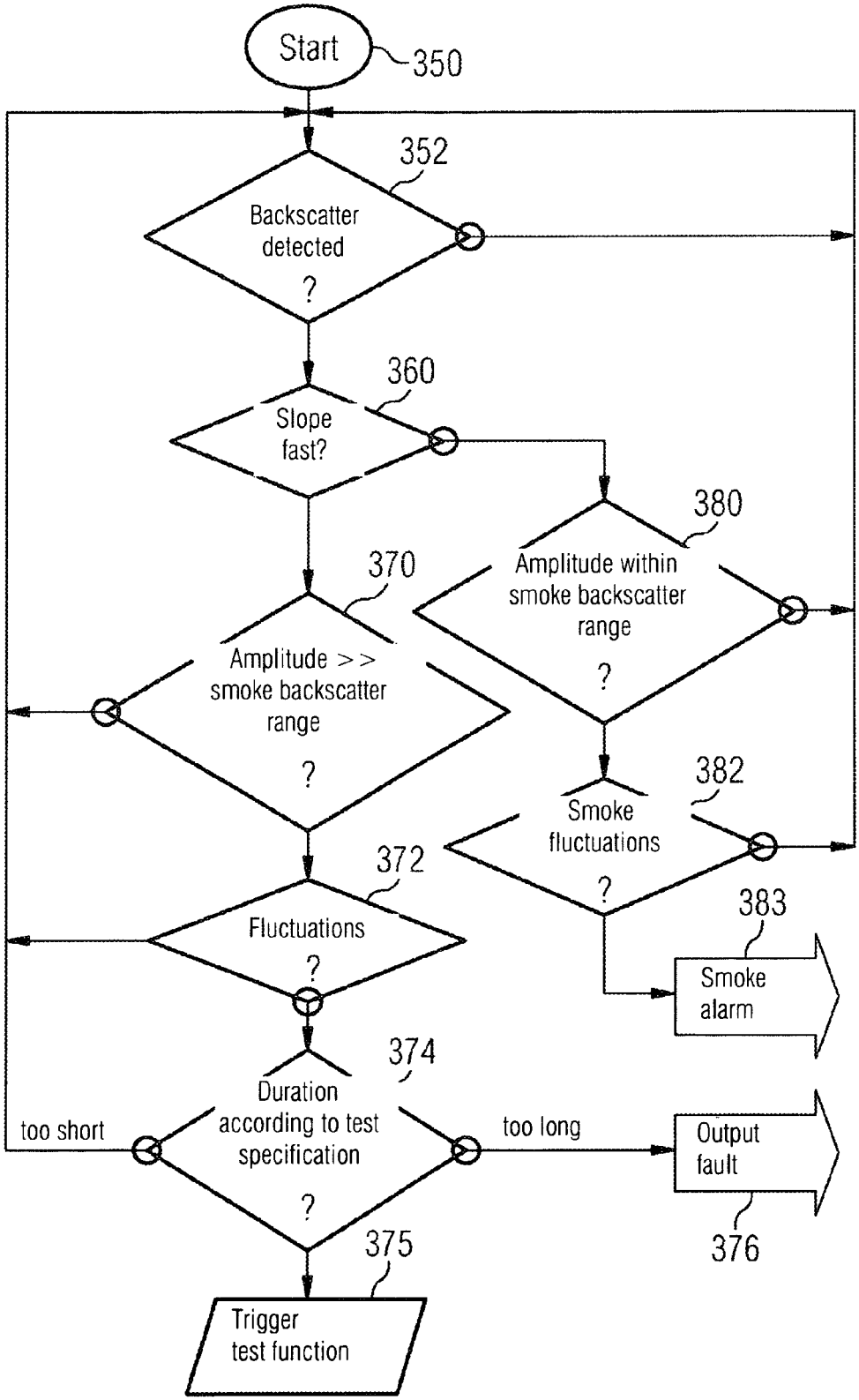
FIG. 3 shows a flow diagram illustrating both normal operation and the triggering of a test function of the smoke alarm illustrated in FIG. 1.

FIG. 3 shows a flow diagram illustrating both normal operation and the triggering of a test function of the smoke alarms 100 and 200 shown in FIGS. 1 and 2.

The method shown in the flow diagram starts with the connection of the smoke alarm to a power supply required for operation, which can be a battery for example. The start of the method is labeled with the reference character 350.

Immediately after the start of the method a first interrogation 352 takes place to verify whether a backscatter signal is being received. If not, the method restarts.

It should be noted here that in the flow diagram shown in FIG. 3 the continuing flow lines, which follow a negative response or "No", start with a circle marked on the corresponding interrogation box. Flow lines, which follow a positive response or "Yes", start without a corresponding circle.

If it is determined in the interrogation 352 that a backscatter signal is being received, the next step is an interrogation 360, in which it is determined whether the temporal profile of the detected backscatter signal features a rise, which is greater than a predetermined reference rise. If so, the method continues with an interrogation 370. If the temporal change in the backscatter signal is smaller than the reference rise, the method continues with an interrogation 380.

The part of the flow diagram that starts with the interrogation 370 is described below.

It is verified with the interrogation 370 whether the strength of the detected backscatter signal is greater than a maximum signal of a predetermined range for smoke backscatter signals. If not, the current scatter medium is obviously not a solid object but more likely smoke. The method then restarts in the hope that the new interrogation 360 will determine a slower rise and the method will continue with the interrogation 380 described below. If the strength of the detected backscatter signal is greater than a maximum signal assigned to smoke detection, the method continues with an interrogation 372.

It is verified by means of the interrogation 372 whether fluctuations are present in the backscatter signal. If fluctuations are determined, the backscatter signal could be based on smoke detection. The method then restarts from the beginning. If no fluctuations of the backscatter signal are determined in the interrogation 372, the method continues with an interrogation 374.

In the interrogation 374 it is verified whether the temporal duration of the detected backscatter signal corresponds to a predetermined specification for triggering a test function of the smoke alarm. If so, a corresponding test function is triggered. This is indicated by the box labeled with the reference character 375.

If it proves in the context of the interrogation 374 that the temporal duration of the detected backscatter signal is below the predetermined specification for triggering the test function, the method restarts from the beginning. If the temporal duration of the detected backscatter signal is above the predetermined specification for triggering the test function, the cause of the detected backscatter signal can only be an object that has inadvertently been introduced into the detection space and produces a temporally constant backscatter. The smoke alarm then outputs a fault message. This is shown in FIG. 3 with the action 376.

The part of the flow diagram starting with the interrogation 380 is described in the following. It is determined with the interrogation 380 whether the amplitude or strength of the backscatter signal is within a predetermined range, which is characteristic of smoke backscatter. If not, the method starts again in the hope that the new interrogation 360 will determine a greater rise and the method will continue with the interrogation 370 described above. If the interrogation 380 determines that the strength of the backscatter signal is within a predetermined range that is typical of smoke backscatter, the method continues with an interrogation 382.

The interrogation 382 determines whether the backscatter signal features fluctuations that are typical of clouds of smoke with regard to their temporal behavior. If not, the method starts again and continues with the interrogation 352 described above. If however the interrogation 382 determines that the backscatter signal features fluctuations that are typical of smoke detection, the smoke alarm outputs an alarm message. This alarm message is labeled with the reference character 383 in FIG. 3.

The described method can therefore trigger three different events, which can be differentiated reliably from one another by the described plurality of interrogations. A first event consists of the triggering of a test function 375, which can be used to verify the functional capability of the smoke alarm. A second event is a fault report 376, which signals that an object is present in the detection space. The third event is the outputting of a smoke alarm 383.

To summarize: the described open optical smoke alarm has a light emitter, which illuminates smoke particles outside the smoke alarm. The light receiver of the smoke alarm is so constituted that it can receive the light backscattered by the smoke particles. If an object is now supplied instead of the smoke particles, this can also be detected by means of the backscattered light. It is thus possible to trigger an alarm for example by holding out a hand or another object, for example an extending handle. In the case of smoke alarms for the domestic field the triggering of an alarm can generally equate to the required test function.

The described open smoke alarm has the following advantages for example:

The smoke alarm can be implemented in miniaturized form.

The required number of optical components in particular is greatly reduced compared with known smoke alarms.

The test function is used to verify precisely the same components which are also used for smoke detection. The complete optical path is therefore tested. With known smoke alarms with the option of triggering a test by way of a button, it was only possible to perform an indirect verification (emitter current measurement, alarm buzzer test, battery test). With known scattered light smoke alarms the optical path itself is generally not verified.

A line of sight block by fixed objects can be identified reliably. This is also an important advantage compared with a closed smoke alarm with labyrinth or with an optical chamber. If the labyrinth or optical chamber is covered for example by a dust cap, a suspended ceiling or cabinet, the smoke alarm in question is no longer functionally capable without a monitoring function being able to identify this.

A smoke alarm test can be triggered easily, for example using an extending handle. There is no need to actuate a test button. Instead it is sufficient to bring a handle, a broom or a mop into proximity to the detection space. There is no need for a ladder with the associated risk of an accident.

The optical smoke detection system is used at the same time as the trigger facility for the test function and for monitoring line of sight obstructions for an open optical smoke alarm. There is therefore no need for additional components or apparatuses.

It should be noted that the embodiments described here only represent a limited selection of possible variants of the invention. It is therefore possible to combine the features of individual embodiments appropriately with one another, so that for the person skilled in the art a plurality of different embodiments should be considered to be disclosed as evident with the variants set out explicitly here.

The invention claimed is:

1. An apparatus for detecting smoke, the apparatus comprising:

a base element with a substantially flat mounting surface;

a light emitter attached to said mounting surface and configured to emit an illumination light;

a light receiver attached to said mounting surface adjacent said light emitter and configured to receive a measurement light resulting from a backscattering of the illumination light at a measurement object present in a detection space, said light receiver outputting an output signal;

said light emitter and said light receiver being disposed flat on said mounting surface, the detection space being disposed outside of the apparatus, no further parts of the apparatus being disposed between the detection space and said light emitter and no further parts of the apparatus being disposed between the detection space and said light receiver;

a data processing device connected to receive the output signal from said light receiver and configured to evaluate temporal changes in the output signal output of said light receiver.

2. The apparatus according to claim 1, wherein said data processing device is additionally configured to evaluate a strength of the output signal.

3. The apparatus according to claim 1, wherein said light emitter and said light receiver are implemented as a first reflection light barrier.

4. The apparatus according to claim 1, wherein a direction of the illumination light runs perpendicular to said mounting surface.

5. The apparatus according to claim 1, wherein said light emitter is configured to emit a pulsed illumination light.

6. The apparatus according to claim 1, wherein said light emitter and said light receiver respectively represent an outer boundary of the apparatus for detecting smoke.

7. The apparatus according to claim 1, which further comprises:

a further light emitter attached to said mounting surface and configured to emit a further illumination light; and a further light receiver attached to said mounting surface adjacent said further light emitter and configured to receive a further measurement light resulting from a backscattering of the further illumination light at a measurement object in a further detection space.

8. A method for verifying a serviceability of a smoke-detecting apparatus according to claim 1, the method which comprises:

introducing a scattering reference object into the detection space, and holding the object in a given position at least for a predetermined time period;

evaluating temporal changes in the output signal output by the light receiver; and outputting a test alarm message if the temporal changes correspond to a predetermined profile.

9. The method according to claim 8, which further comprises moving the reference object according to a predetermined temporal pattern, the predetermined profile corresponding at least qualitatively to the predetermined temporal pattern.

10. The apparatus according to claim 1, wherein said data processing facility is configured to evaluate temporal changes in the output signal output by the light receiver, the apparatus being configured to output a test alarm message and it being possible to output the test alarm message when a scattering reference object introduced into the detection space and held in the same position for at least a predetermined time period is moved according to a predetermined temporal pattern that corresponds at least qualitatively to a predetermined profile.

11. The apparatus according to claim 1, which further comprises:

a further light emitter attached to said mounting surface and configured to emit a further illumination light; and a further light receiver attached to said mounting surface adjacent said further light emitter and configured to receive a further measurement light resulting from a backscattering of the further illumination light at a measurement object in a further detection space;

said further light emitter and said further light receiver being disposed flat on said mounting surface, no further parts of the apparatus being disposed between the detection space and said further light emitter and no further parts of the apparatus being disposed between the detection space and said further light receiver.

* * * * *